US010892089B2

(12) United States Patent
Kamimura et al.

(10) Patent No.: US 10,892,089 B2
(45) Date of Patent: Jan. 12, 2021

(54) METHOD FOR PRODUCING MAGNETIC COMPONENT USING AMORPHOUS OR NANOCRYSTALLINE SOFT MAGNETIC MATERIAL

(71) Applicant: TOYOTA JIDOSHA KABUSHIKI KAISHA, Toyota (JP)

(72) Inventors: Airi Kamimura, Toyota (JP); Kazuaki Haga, Toyota (JP); Kensuke Komori, Toyota (JP); Katsuhiko Tatebe, Seto (JP); Shingo Fubuki, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 171 days.

(21) Appl. No.: 16/148,198

(22) Filed: Oct. 1, 2018

(65) Prior Publication Data

US 2019/0156999 A1 May 23, 2019

(30) Foreign Application Priority Data

Nov. 20, 2017 (JP) ..... 2017-222910

(51) Int. Cl.

| | |
|---|---|
| ***C21D 8/02*** | (2006.01) |
| ***H01F 1/153*** | (2006.01) |
| ***H01F 41/00*** | (2006.01) |
| ***H01F 1/16*** | (2006.01) |
| ***C21D 1/26*** | (2006.01) |

(Continued)

(52) U.S. Cl.

CPC ..... *H01F 41/00* (2013.01); *B21D 28/34* (2013.01); *C21D 1/26* (2013.01); *H01F 1/15333* (2013.01); *H01F 1/16* (2013.01); *H01F 3/04* (2013.01); *H01F 41/0226* (2013.01); *C21D 2201/03* (2013.01); *C21D 2261/00* (2013.01); *C22C 45/008* (2013.01); *C22C 2200/02* (2013.01); *C22C 2202/02* (2013.01)

(58) Field of Classification Search

None

See application file for complete search history.

(56) References Cited

U.S. PATENT DOCUMENTS 4,265,684 A * 5/1981 Boll ..... C21D 6/00 148/121

4,328,411 A * 5/1982 Haller ..... B23K 15/08 219/121.18

(Continued)

FOREIGN PATENT DOCUMENTS

JP 2008-213410 A 9/2008

JP 2011-149045 A 8/2011

*Primary Examiner* — George Wyszomierski

(74) *Attorney, Agent, or Firm* — Oliff PLC

(57) ABSTRACT

The present disclosure provides a method for producing a magnetic component that enables efficient processing of an amorphous soft magnetic material or a nanocrystalline soft magnetic material. The method for producing a magnetic component comprising an amorphous soft magnetic material or nanocrystalline soft magnetic material comprises: a step of preparing a stacked body comprising a plurality of plate-shaped amorphous soft magnetic materials or nanocrystalline soft magnetic materials; a step of heating at least a portion of shearing in the stacked body to a temperature equal to or higher than the crystallization temperature of the soft magnetic materials; and a step of shearing the stacked body at the portion of shearing after the step of heating.

5 Claims, 7 Drawing Sheets

(51) Int. Cl.

| | |
|---|---|
| ***B21D 28/34*** | (2006.01) |
| ***H01F 3/04*** | (2006.01) |
| ***H01F 41/02*** | (2006.01) |
| *C22C 45/00* | (2006.01) |

(56) References Cited

U.S. PATENT DOCUMENTS

| | | | | |
|---|---|---|---|---|
| 5,005,456 | A * | 4/1991 | Ballard | B26D 7/10 83/170 |
| 10,454,352 | B1 * | 10/2019 | Sculthorpe | H02K 15/02 |
| 2008/0229799 | A1 * | 9/2008 | Musat | B21D 28/22 72/336 |

* cited by examiner

200μm Crystallized region

METHOD FOR PRODUCING MAGNETIC COMPONENT USING AMORPHOUS OR NANOCRYSTALLINE SOFT MAGNETIC MATERIAL

CROSS REFERENCE TO RELATED APPLICATIONS

The present application claims priority from Japanese patent application JP 2017-222910 filed on Nov. 20, 2017, the content of which is hereby incorporated by reference into this application.

BACKGROUND

Technical Field

The present disclosure relates to a method for producing a magnetic component using an amorphous or nanocrystalline soft magnetic material.

Background Art

It has heretofore been known that a magnetic component used for electric equipment, such as a motor, voltage converter, transformer, noise filter, or choke coil, is prepared with the use of a soft magnetic material. For example, a mold may be prepared with the use of a soft magnetic material, and the mold may be adequately processed to prepare a magnetic component.

Development of an excellent soft magnetic material has been attempted in order to improve performance of a magnetic component. For example, amorphous soft magnetic materials and nanocrystalline soft magnetic materials have been developed. These soft magnetic materials are excellent in terms of low loss, high electric resistance, high magnetic flux density, and good excitation properties, and such materials are used as magnetic components such as core materials for motors. These soft magnetic materials need to be rapidly cooled to acquire an amorphous structure or nanocrystalline structure, and are usually prepared by means of a melt extraction, for example, single-roll melt extraction. In addition, it is necessary to thin the material in order to increase the cooling rate, and the resulting substrate is in the form of, for example, a thin plate with a thickness of 15 to 35 μm. However, amorphous soft magnetic materials and nanocrystalline soft magnetic materials have a high Vickers hardness and thus they are very hard. Accordingly, there is a problem that it is difficult to process them.

JP 2008-213410 A attempts to provide a method for producing a laminate that can be easily punched out in order to improve processability of amorphous and nanocrystalline metal ribbons. Such method comprises: coating soft magnetic metal ribbons of a thickness of 8 to 35 μm with a thermosetting resin at a thickness of 0.5 μm to 2.5 μm to prepare composite ribbons; superposing the composite ribbons to be a total thickness of 50 μm to 250 μm, thereby to prepare a laminate, punching out the laminate to obtain a laminated block, and superposing the laminated block on top of each other to prepare a laminate. In such method, the thermosetting resin is hardened via heating at 300° C. or lower and the laminate is then subjected to punching.

SUMMARY

As described above, a soft magnetic material is used for a magnetic component. For example, an electromagnetic steel sheet has heretofore been used as a soft magnetic material constituting a core material for a motor. In order to prepare such electromagnetic steel sheet in a desired shape, a press method for punching out with a press die is adopted. In such a case, a press die used to punch out the electromagnetic steel sheet is made of super steel with a hardness of about 1,000 HV, which is significantly harder than the electromagnetic steel sheet, and an electromagnetic steel sheet can be efficiently punched out with the use thereof.

When the amorphous soft magnetic material or nanocrystalline soft magnetic material is used, however, abrasion of the press die disadvantageously takes place at the time of punching because such material is very hard. As shown in the graph of FIG. 1, for example, the hardness of an electromagnetic steel sheet is about 200 HV while the hardness of an amorphous soft magnetic material is about 600 HV. Since the hardness of the amorphous soft magnetic material is about 3 times higher than that of the electromagnetic steel sheet, a material constituting a press die for punching out the amorphous soft magnetic material is required to have a hardness being at least 3 times higher than that of the material (super steel) constituting a press die used for pressing the electromagnetic steel sheet. However, there is no material having hardness that is 3 times or higher than that of super steel. This necessitates the use of super steel for a press die. However, due to a high degree of hardness of the amorphous soft magnetic material, the problem of abrasion of a press die become conspicuous, and it is impossible to efficiently produce a magnetic component. A nanocrystalline soft magnetic material suffers from similar problems.

As described above, an amorphous soft magnetic material and a nanocrystalline soft magnetic material are prepared in the form of a thin plate having, for example, about 5 to 50 μm (in some embodiments, about 15 to 35 μm), in order to increase a cooling rate. Thus, in order to achieve a production efficiency equivalent to that achieved by a conventional technique, it is necessary to superpose a plurality of materials on the surfaces of each other during the step of press work. In such a case, the problem of abrasion as described above also arises.

In JP 2008-213410 A, processability is evaluated from the viewpoint that misalignment would not occur between soft magnetic alloy ribbons, laminates, and laminated blocks. That is, JP 2008-213410 A is not intended to dissolve the problems concerning abrasion of a shearing apparatus, such as a press die.

The present disclosure provides a method for producing a magnetic component that can efficiently process an amorphous soft magnetic material or nanocrystalline soft magnetic material.

Embodiments of the present disclosure are described below.

(1) A method for producing a magnetic component comprising an amorphous soft magnetic material or a nanocrystalline soft magnetic material comprising:

a step of preparing a stacked body comprising a plurality of plate-shaped amorphous soft magnetic materials or nanocrystalline soft magnetic materials;

a step of heating at least a portion of shearing in the stacked body to a temperature equal to or higher than the crystallization temperature of the soft magnetic materials; and a step of shearing the stacked body at the portion of shearing after the step of heating.

(2) The method for producing a magnetic component according to (1), wherein the portion of shearing is heated by fusion-cutting the stacked body at a position outside the portion of shearing.

(3) The method for producing a magnetic component according to (2), wherein the stacked body is fusion-cut by means of laser cutting, plasma cutting, or gas cutting.

(4) The method for producing a magnetic component according to (1), wherein the portion of shearing is heated by pressing a metal tool configured to abut on the portion of shearing or on a position outside and near the portion of shearing against the surface of the stacked body in a heated state.

(5) The method for producing a magnetic component according to any one of (1) to (4), wherein the stacked body is sheared via punching out using a press die.

The present disclosure provides a method for producing a magnetic component that enables efficient processing of an amorphous soft magnetic material or a nanocrystalline soft magnetic material.

DETAILED DESCRIPTION

Figure 1:
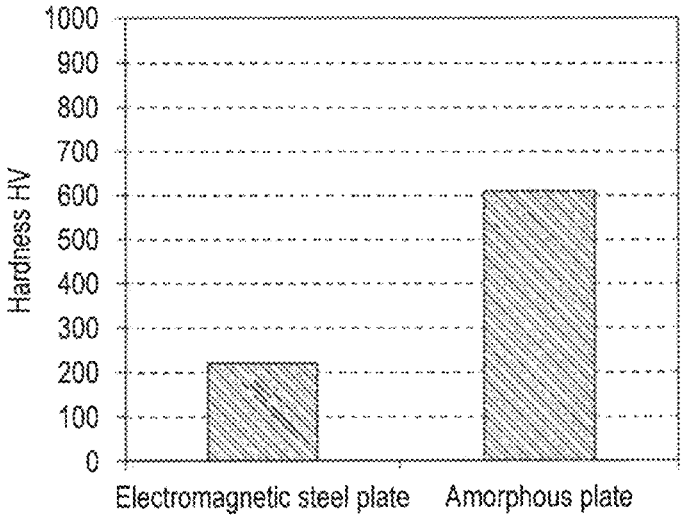
FIG. 1 shows a graph showing examples of hardness (HV) of an electromagnetic steel sheet (composition: Fe-3 mass % Si) and that of an amorphous soft magnetic material (composition: $Fe_{84}B_{13}Ni_3$).

The present embodiment relates to a method for producing a magnetic component comprising an amorphous soft magnetic material or a nanocrystalline soft magnetic material, comprising: a step of preparing a stacked body comprising a plurality of plate-shaped amorphous soft magnetic materials or nanocrystalline soft magnetic materials; a step of heating at least a portion of shearing in the stacked body to a temperature equal to or higher than the crystallization temperature of the soft magnetic materials; and a step of shearing the stacked body at the portion of shearing after the step of heating. In the present embodiment, the portion of shearing of the amorphous soft magnetic material or the nanocrystalline soft magnetic material is heated to a temperature equal to or higher than a crystallization temperature of the soft magnetic materials (e.g., 400° C. or higher), thereby lowering the hardness of the heated portion. This is because crystallization of the soft magnetic material proceeds and the hardness thereof is lowered as a result of the heating. Then, the stacked body is sheared at the portion of shearing where hardness is lowered with the use of a tool such as a press die. As a result, a magnetic component can be prepared while suppressing abrasion of a tool used for shearing.

Hereafter, the present embodiment is described in detail.

[Step of Preparation]

In the present embodiment, at the outset, a stacked body in which a plurality of plate-shaped amorphous soft magnetic materials or nanocrystalline soft magnetic materials superposed on the surfaces of each other is prepared.

Examples of the amorphous soft magnetic materials or the nanocrystalline soft magnetic materials include, but are not limited to, materials comprising at least one magnetic metal selected from the group consisting of Fe, Co, and Ni and at least one non-magnetic metal selected from the group consisting of B, C, P, Al, Si, Ti, V, Cr, Mn, Cu, Y, Zr, Nb, Mo, Hf, Ta, and W. Representative examples of the amorphous soft magnetic materials or nanocrystalline soft magnetic materials include, but are not limited to, FeCo-based alloys (e.g., FeCo and FeCoV), FeNi-based alloys (e.g., FeNi, FeNiMo, FeNiCr, and FeNiSi), FeAl-based alloys or FeSi-based alloys (e.g., FeAl, FeAlSi, FeAlSiCr, FeAlSiTiRu, and FeAlO), FeTa-based alloys (e.g., FeTa, FeTaC, and FeTaN), and FeZr-based alloys (e.g., FeZrN). As other amorphous soft magnetic materials or nanocrystalline soft magnetic materials, for example, Co alloys comprising Co and at least one metal selected from among Zr, Hf, Nb, Ta, Ti, and Y can be used. In some embodiments, Co content in the Co alloys may be 80 at % or more. Such a Co alloy easily becomes amorphous at the time of film formation and it exhibits excellent soft magnetic properties due to low-level crystalline magnetic anisotropy, crystal defect, and grain boundary. Examples of amorphous soft magnetic materials include CoZr, CoZrNb, and CoZrTa-based alloys.

An amorphous soft magnetic material has an amorphous structure as a main structure. In the amorphous structure, no clear peak is observed in X-ray diffraction patterns, but only broad halo patterns are observed. While a nanocrystalline structure can be formed with the application of a thermal treatment to an amorphous structure, a diffraction peak is observed at a position corresponding to an interstitial space of a crystal plane in the nanocrystalline soft magnetic material having a nanocrystalline structure. A crystallite diameter can be calculated on the basis of the width of the diffraction peak using the Scherrer equation. In general, the term "nanocrystals" refers to crystals having a crystallite diameter of less than 1 μm, which is calculated on the basis of the half width of the diffraction peak obtained via X-ray diffraction analysis using the Scherrer equation. In some embodiments, the crystallite diameter of nanocrystals (i.e., a crystallite diameter calculated on the basis of the half width of the diffraction peak obtained via X-ray diffraction analysis using the Scherrer equation) may be 100 nm or less, and may be 50 nm or less. In some embodiments, the crystallite diameter of nanocrystals may be 5 nm or more. When the crystallite diameter of nanocrystals is of the size as described above, a soft magnetic property is improved. A crystallite diameter of a conventional electromagnetic steel sheet is micro order (μm), and it is generally 50 μm or more.

An amorphous soft magnetic material can be obtained, for example, by melting a starting metal material blended to have a desired composition at a high temperature in a high-frequency melting furnace or the like to obtain a uniform molten metal, and then quenching it. Alternatively, the molten metal of the starting metal material can be applied to a rotating cooling roll to obtain a thin plate-shaped amorphous soft magnetic material (which is also referred to as a "ribbon-shaped").

A nanocrystalline soft magnetic material can be prepared by further subjecting the amorphous soft magnetic material to an adequate thermal treatment. Conditions for the thermal treatment are not particularly limited, and adequate conditions can be selected in accordance with, for example, the composition of a starting metal material or magnetic properties to be expressed. For example, the thermal treatment is carried out at a temperature higher than the crystallization temperature of the soft magnetic material to be used, although the temperature is not limited. By subjecting an amorphous soft magnetic material to the thermal treatment, an amorphous soft magnetic material can be converted into a nanocrystalline soft magnetic material. In addition, nanocrystals are allowed to deposit in the amorphous soft magnetic material to improve magnetic properties of interest. In some embodiments, the thermal treatment may be carried out in an inert gas atmosphere.

In some embodiments, the surface of the amorphous soft magnetic material or the nanocrystalline soft magnetic material may be covered by an insulation film. An example of the insulation film is an oxide film such as $SiO_2$. With the insulation film, a loss caused by an eddy current can be reduced.

Before the thermal treatment step described below, the hardness of the amorphous soft magnetic material is, for example, 300 HV or higher, and may be 500 HV or higher. Before the thermal treatment step described below, the hardness of the nanocrystalline soft magnetic material is, for example, 300 HV or higher, and may be 600 HV or higher.

A thickness of a plate-shaped soft magnetic material is, for example, 5 to 50 μm, and may be 15 to 35 μm. A plurality of plate-shaped soft magnetic materials are superposed on the surfaces of each other to form a stacked body. While a thickness of the stacked body is not particularly limited, it is, for example, 20 to 1,000 μm, and may be 50 to 500 μm. The number of the plate-shaped soft magnetic materials to be superposed on the surfaces of each other may be 20 or less.

An adhesive layer such as a thermostable resin may or may not be provided between the plate-shaped soft magnetic materials. An example of the thermostable resin that can be used is a thermosetting resin, and examples of the thermosetting resin include an epoxy resin, a polyimide resin, a polyamide imide resin, and an acrylic resin.

[Step of Thermal Treatment]

Subsequently, at least a portion of shearing in the stacked body is heated to a temperature equal to or higher than the crystallization temperature of the soft magnetic material. The portion of shearing in the stacked body means a portion which is sheared with the use of, for example, a press die in the later step.

Figure 2:
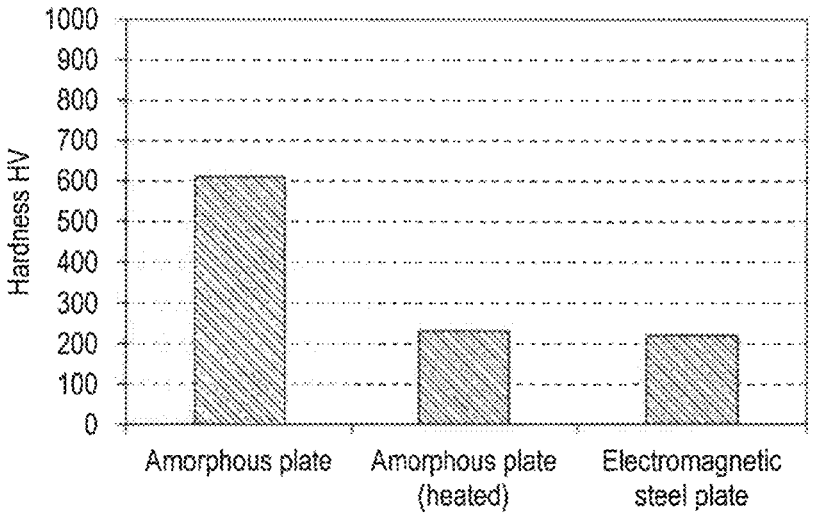
FIG. 2 shows a graph showing examples of hardness (HV) of an amorphous soft magnetic material (composition: $Fe_{84}B_{13}Ni_3$), that of an amorphous soft magnetic material after a heat treatment, and that of an electromagnetic steel sheet (composition: Fe-3 mass % Si).

When the amorphous soft magnetic material or nanocrystalline soft magnetic material is heated to a temperature equal to or higher than the crystallization temperature, crystallization will proceed. As crystallization proceeds, the hardness is lowered. Thus, it becomes easy to perform shearing in the later step. For example, by heating an amorphous soft magnetic material (composition: $Fe_{84}B_{13}Ni_3$) to a temperature equal to or higher than the crystallization temperature to proceed crystallization, the hardness thereof is lowered, and the hardness of the heated area becomes equivalent to, for example, that of an electromagnetic steel sheet (composition: Fe-3 mass % Si), as shown in FIG. 2. The hardness of the amorphous soft magnetic material is about 609 HV before the thermal treatment step, and it is lowered to about 231 HV after the thermal treatment step. The thermal treatment step was carried out by placing the amorphous soft magnetic material (thickness: 30 μm) into a heating furnace and then heating the material at 400° C. for 60 seconds. The hardness was measured at 23° C. This demonstrates that the hardness of the soft magnetic material can be reduced by heating the soft magnetic material to a temperature equal to or higher than the crystallization temperature.

The "crystallization temperature" means a temperature in which crystallization takes places. At the time of the crystallization, an exothermic reaction takes places. Thus, the crystallization temperature can be determined by measuring the temperature change accompanying the crystallization. For example, a differential scanning calorimeter (DSC) can be used to measure the crystallization temperature at a predetermined heating speed (e.g., 0.67 $Ks^{-1}$). The crystallization temperature of the amorphous soft magnetic material varies depending on materials. For example, the crystallization temperature is 300° C. to 500° C. Also, the crystallization temperature of the nanocrystalline soft magnetic material can be measured via differential scanning calorimetry (DSC). Although crystallization has already occurred in the nanocrystalline soft magnetic material, further crystallization would take place by heating such material to a temperature equal to or higher than the crystallization temperature. The crystallization temperature of the nanocrystalline soft magnetic material is, for example, 300° C. to 500° C., although it varies depending on the materials.

A heating temperature in the thermal treatment step is not particularly limited as long as it is equal to or higher than the crystallization temperature. For example, the heating temperature is 350° C. or higher, and may be 400° C. or higher. By adjusting the heating temperature at 400° C. or higher, crystallization can proceeds efficiently. The heating temperature is, for example, 600° C. or lower, and may be 520° C. or lower. By adjusting the heating temperature at 520° C. or lower, it becomes easy to prevent excessive crystallization, and generation of by-products (e.g., $Fe_2B$) can be suppressed.

The heating time in the thermal treatment step is not particularly limited. In some embodiments, the heating time may be 1 second to 10 minutes, and may be 1 second to 5 minutes.

The thermal treatment may be performed such that the hardness of the soft magnetic material after the thermal treatment (at room temperature; e.g., 23° C.) becomes 300 HV or less (in some embodiments, 250 HV or less) from the viewpoint of processability. The hardness of the soft magnetic material after the thermal treatment can be regulated by adjusting heating temperature, heating duration, and other conditions.

The heat treatment may be performed by heating at least the portion of shearing of the stacked body. Namely, the stacked body may be heated in at least the portion of shearing. Only the portion of shearing may be heated, or the entire stacked body may be heated. In some embodiments, the thermal treatment may be performed by heating only the portion of shearing. However, due to a thermal conduction, the thermal treatment is actually performed with a certain width, and crystallization takes place. In order to leave the region of the initial state as much as possible, the portion of shearing may be heated by heating a region slightly outside the actual portion of shearing.

A method for heating the portion of shearing is not particularly limited. For example, a metal tool configured to abut against the portion of shearing (or a metal tool configured to abut against the portion outside in the vicinity of the portion of shearing) is pressed against the surface of the stacked body in a heated state. A metal tool configured to abut against the portion of shearing can be prepared by imitating, for example, the press die used in the later step. For example, a method for heating the portion of shearing includes an irradiation of a laser beam to the portion of shearing. As described above, the thermal treatment is performed with a certain width due to the thermal conduction. Thus, in some embodiments, when heating via laser irradiation, the portion of shearing may be heated by irradiating a laser beam to the portion slightly outside the actual portion of shearing (e.g., the portion outside the actual portion of shearing by about 0.1 to 0.5 mm). In some embodiments, the portion of shearing may be heated by irradiating a laser beam to the portion about 0.1 to 0.3 mm outside the actual portion of shearing.

When the portion of shearing is heated via laser application, the stacked body may be fusion-cut simultaneously with heating of the portion of shearing via laser application. In such a case, as shown in, for example, FIG. 7, the layers of the soft magnetic materials may be fused to each other at the portion of laser cutting. The fused portion can be removed in the later step of shearing. In addition to laser cutting, for example, plasma cutting or gas cutting may be employed. The stacked body is first fusion-cut via laser cutting or other means and then punched out at the portion of shearing. Thus, excellent dimensional accuracy can be achieved. Accordingly, in some embodiments of the present disclosure, the step of the thermal treatment comprises fusion-cutting the stacked body at a position outside the portion of shearing to heat the portion of shearing. Then, the stacked body can be sheared via a process of punching out with the use of a press die. The stacked body can be fusion-cut at a position, for example, outside of the portion of shearing by about 0.1 to 0.5 mm. In some embodiments, the stacked body may be fusion-cut at a position about 0.1 to 0.3 mm outside of the portion of shearing.

[Step of Shearing]

Subsequently, the stacked body is sheared at the portion of shearing after the step of the thermal treatment. Thus, a magnetic component can be obtained. Shearing is performed at a position where crystallization proceeds and the hardness is lowered as a result of the thermal treatment. Therefore, even in the case of using the amorphous soft magnetic material or the nanocrystalline soft magnetic material having a high hardness, abrasion of a tool for shearing can be suppressed.

In some embodiments, shearing may be carried out by punching out the stacked body with the use of a press die. For example, as a press die that can be used, super steel may be used. Prior to the process of punching out, a mold and/or a stacked body (in particular, the portion of shearing) may be coated with a lubricant.

In the manner described above, even in the case of using the amorphous soft magnetic material or the nanocrystalline soft magnetic material having a high degree of hardness, a magnetic component can be produced while suppressing abrasion of a tool (or apparatus) used in the step of shearing.

The magnetic component obtained may be subjected to a further processing as necessary, and can be used for desired electric apparatus of interest. Examples of magnetic components include, but are not particularly limited to, core materials of rotors or electric reactors, voltage convertors, and firing plugs.

EXAMPLES

Hereafter, examples of the present disclosure are described; although the technical scope of the present disclosure is not restricted by the following examples.

Example 1

Figure 3:
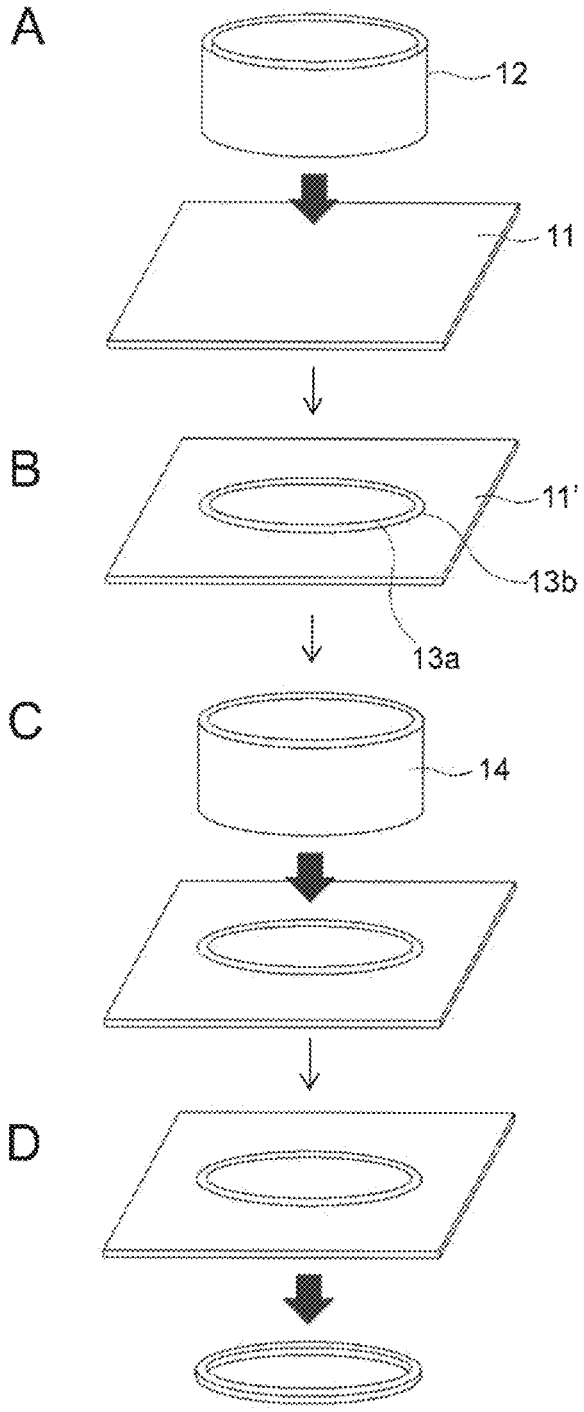
FIG. 3 shows a schematic process diagram explaining the steps in Example 1.

Example 1 is performed in accordance with a schematic process diagram shown in FIG. 3. Namely, an amorphous plate (thickness: 30 μm; crystallization temperature: 400° C.; hardness: 609 HV) was prepared as an amorphous soft magnetic material, the portion of shearing thereof was heated and punched out with the use of a press die, and then an extent of press die abrasion was evaluated. The crystallization temperature was determined by measuring the exothermal peak at a heating rate of 0.67 $Ks^{-1}$ via differential scanning calorimetry (DSC).

First, the amorphous plate 11 was prepared. Also, a mold 12 configured to abut against a portion to be sheared by a press die in a later step in the surface of the amorphous plate 11 was prepared. Then, while heating the mold 12 at 400° C., the mold was pressed against the amorphous plate 11 for 10 seconds in the air atmosphere (FIG. 3 (A)). Thus, the portion of shearing was heated, and a partially crystallized amorphous plate 11' was obtained (FIG. 3 (B)). In FIG. 3B, the heated regions are indicated by numeral references 13*a* and 13*b*, respectively.

Subsequently, the surface of the amorphous plate 11' was coated with a lubricant, the plate was mounted on a press machine, and the plate was then punched out with the use of a press die 14 (FIG. 3 (C)). Super steel was used as a material of the press die 14 and the plate was punched out at a rate of 260 mm/sec. Thereby, the amorphous plate was punched out in a ring shape (outer diameter: 30 mm; inner diameter: 25 nn) (FIG. 3 (D)).

This process of punching out was repeated 1,000 times, and the degree of abrasion of the press die was examined.

Comparative Example 1

The amorphous plate 11 was punched out in a ring shape in the same manner as in Example 1, except that the portion of shearing was not subjected to the thermal treatment. This process of punching was repeated 1,000 times and the degree of abrasion of the press die was examined.

(Results)

Figure 4:
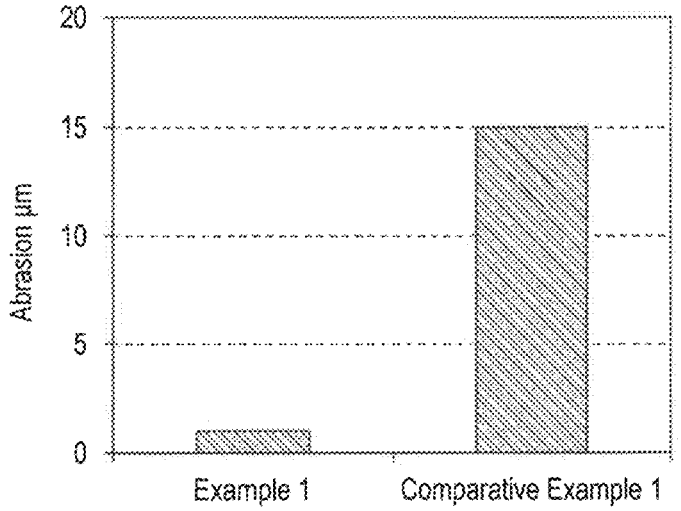
FIG. 4 shows a graph demonstrating the results of Example 1 and Comparative Example 1.

FIG. 4 shows the results of press die abrasion in Example 1 and Comparative Example 1. It was confirmed that the degree of press die abrasion was very low in Example 1 while the degree of press die abrasion was high in Comparative Example 1. The results demonstrate that hardness of an amorphous plate can be reduced by thermal treatment, and then press die abrasion can be suppressed.

Example 2

Figure 5:
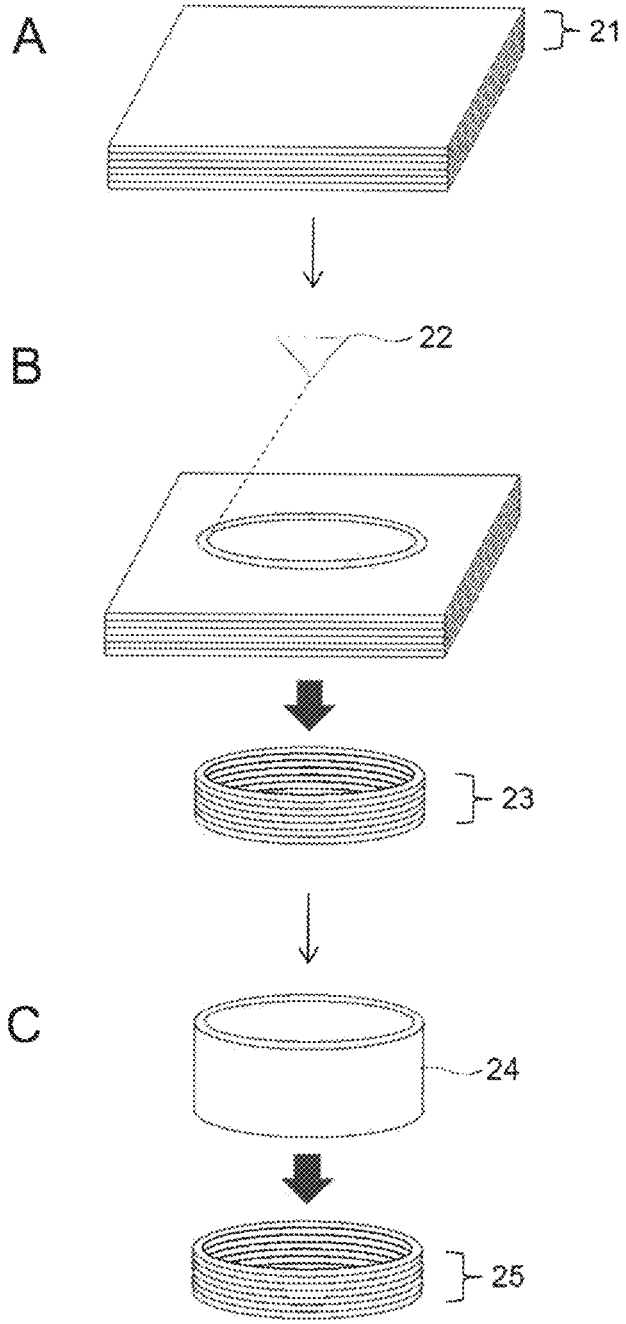
FIG. 5 shows a schematic process diagram explaining the steps in Example 2.

Example 2 is performed in accordance with a schematic process diagram shown in FIG. 5. Namely, a stacked body was prepared using amorphous plates (thickness: 25 μm; crystallization temperature: 490° C.; hardness: 535 HV) as amorphous soft magnetic materials, the stacked body was cut (fusion-cut) by heating the portion of shearing with a laser beam, and the stacked body was then punched out with the use of a press die.

At the outset, 6 amorphous plates were superposed on the surfaces of each other to form a stacked body 21 (FIG. 5 (A)).

Figure 7:
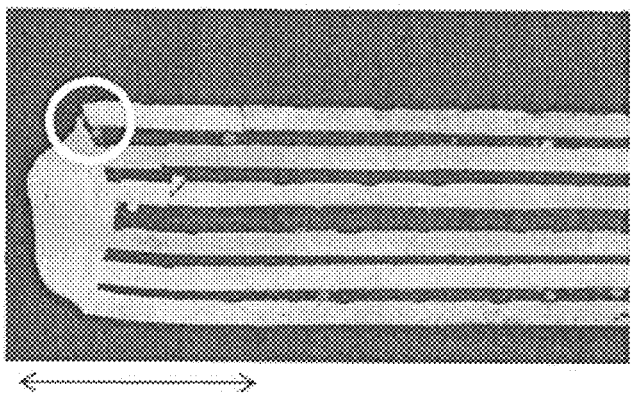
FIG. 7 shows an electron micrograph showing a cross section of the fusion-cut stacked body obtained in Example 2.

Subsequently, the stacked body was fusion-cut in a ring shape along a line 0.1 mm outside the portion to be sheared in a later step using a laser beam of 0.5 kW or more from a laser irradiation apparatus 22 (FIG. 5 (*b*)). FIG. 7 shows an electron micrograph of a cross section of the stacked body 23 cut out by fusion-cutting. As shown in FIG. 7, layers were fused to each other in the edges of the fusion-cut region. In addition, crystallization was observed in the region of about 200 μm from the edge. As shown in the portion indicated by the white circle, fracture was also observed. This indicates that the hardness of that portion is significantly reduced. In the electron micrograph shown in FIG. 7, the black regions between layers are the parts infiltrated with the resin used for photographing.

Subsequently, the surface of the stacked body 23 cut out via fusion-cutting was coated with a lubricant, and the stacked body was mounted on a press machine. Then, the stacked body was punched out in a ring shape (outer diameter: 30 mm; inner diameter: 25 mm) with the use of the press die 24 (super steel) at a rate of 260 mm/sec (FIG. 5 (*c*)). As a result, the fused portions were removed, and a magnetic component 25 was obtained with excellent dimensional accuracy.

This process of punching was repeated 1,000 times and the degree of press die abrasion was examined.

Comparative Example 2

The stacked body composed of 6 amorphous plates superposed on the surfaces of each other was coated with a lubricant, and the stacked body was punched out with the use of the press die 24 at a rate of 260 mm/sec without thermal treatment. This process of punching was repeated 1,000 times and the degree of press die abrasion was examined.

(Results)

Figure 6:
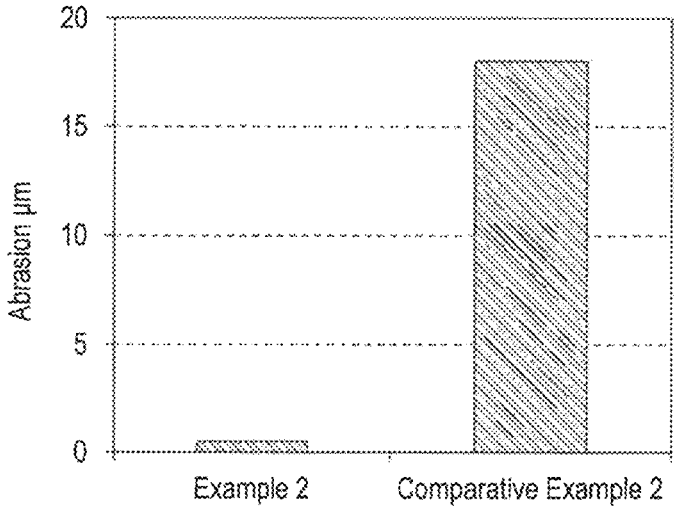
FIG. 6 shows a graph showing the results of Example 2 and Comparative Example 2.

FIG. 6 shows the results of press die abrasion examined in Example 2 and Comparative Example 2. It was confirmed that the degree of press die abrasion was very low in Example 2 while the degree of press die abrasion was high in Comparative Example 2. The results demonstrate that the hardness of an amorphous plate can be lowered by performing thermal treatment with laser irradiation and that press die abrasion can be suppressed by punching out the stacked body at the region where the hardness is lowered.

While embodiments of the present disclosure were described in detail with reference to the figures, specific constitutions of the invention are not limited to the embodiments described above. The present disclosure encompasses design modification made within the scope of the present disclosure.

DESCRIPTION OF SYMBOLS

11: Amorphous plate
11': Amorphous plate after thermal treatment
12: Heated mold (metal tool)
13: Heated region
14: Press die
21: Stacked body (6-layered amorphous plates)
22: Laser applicator
23: Fusion-cut stacked body
24: Press die
25: Magnetic component

What is claimed is:

1. A method for producing a magnetic component comprising an amorphous soft magnetic material or a nanocrystalline soft magnetic material comprising:

preparing a first stacked body comprising a plurality of plate-shaped amorphous soft magnetic materials or nanocrystalline soft magnetic materials;

heating at least a portion of shearing in the first stacked body to a temperature equal to or higher than the crystallization temperature of the soft magnetic materials, wherein the heating includes fusion-cutting the first stacked body at a position outside the portion of shearing so as to remove a fusion-cut stacked body from the first stacked body; and shearing the fusion-cut stacked body at the portion of shearing after the heating.

2. The method for producing a magnetic component according to claim 1, wherein the fusion-cutting includes laser cutting, plasma cutting, or gas cutting.

3. The method for producing a magnetic component according to claim 1, wherein the fusion-cut stacked body is sheared via punching out using a press die.

4. The method for producing a magnetic component according to claim 1, wherein the fusion cutting includes cutting with a laser beam.

5. The method for producing a magnetic component according to claim 1, wherein the first stacked body is fusion-cut at a position about 0.1 to 0.5 mm outside of the portion of shearing.

* * * * *